United States Patent [19]

Sohler

[11] 4,121,317

[45] Oct. 24, 1978

[54] MOBILE PNEUMATIC APPARATUS FOR SUCKING AND BLOWING FIBER DUST FROM TEXTILE MACHINES

[75] Inventor: Hubert Sohler, Wangen im Allgäu, Germany

[73] Assignee: Hubert Sohler GmbH, Wangen im Allgau, Germany

[21] Appl. No.: 678,590

[22] Filed: Apr. 20, 1976

[30] Foreign Application Priority Data

Apr. 25, 1975 [DE] Fed. Rep. of Germany ..... 2518522

[51] Int. Cl.[2] ..... A47L 5/14

[52] U.S. Cl. ..... 15/312 A; 15/352

[58] Field of Search ..... 15/312 R, 312 A, 352

[56] References Cited

U.S. PATENT DOCUMENTS

| | | | |
|---|---|---|---|
| 3,009,838 | 11/1961 | Preston | 15/312 A X |
| 3,011,205 | 12/1961 | Holtzclaw | 15/312 A |
| 3,276,065 | 10/1966 | King et al. | 15/312 A |

*Primary Examiner*—Christopher K. Moore

*Attorney, Agent, or Firm*—Burgess, Dinklage & Sprung

[57] ABSTRACT

A mobile pneumatic apparatus for removing lint, dust, dirt and debris from textile machinery and the locus thereof, having a fan which on one side thereof has a pair of suction conduits generally opposed to one another and has on the other side a blower member, each of the suction conduits having filter means for removal of lint, dust, dirt and debris, the apparatus improved by the inclusion of a normally open suction gate downstream of the filter means in each of the suction conduits which upon actuation closes to prevent air from passing therethrough, and a normally open by-pass conduit in each of the suction conduits downstream of the filter means, the branch conduits by-passing the gate and being directed toward the filter means. Means are provided to close the suction gate by opening the branch conduit gate. By actuation of the suction conduit gate and branch conduit gate in respect of one suction conduit, the air being passed through the other suction conduit functions to backblow the filter and allow the removal of the lint, dust, dirt and debris. A chute is provided with an openable and closable cute gate in general registry with the filter means for allowing the removal of the dust, dirt and debris being discharged from the filter. Several embodiments of the mobile pneumatic apparatus are disclosed, including one having a second branch conduit in association with each suction conduit, which conduit terminates upstream of the filter and assists in the removal of the lint, dust, dirt and debris impinged thereon.

11 Claims, 10 Drawing Figures

MOBILE PNEUMATIC APPARATUS FOR SUCKING AND BLOWING FIBER DUST FROM TEXTILE MACHINES

BACKGROUND OF THE INVENTION

1. Field of the Invention

This invention relates to a pneumatic apparatus for the removal of particulate matter, such as lint, dust, dirt and debris surrounding textile machinery. More especially this invention relates to a mobile pneumatic appliance disposed upon a trackway or rail including means for the self-propulsion of the appliance along the trackway and means for discharging recovered lint, dust, dirt and debris from either end of the apparatus as it moves along the trackway.

2. Discussion of the Prior Art

Mobile pneumatic appliances are already known for sucking and blowing fiber fly or lint from textile machines, in particular spinning machines, and from the floor or other surfaces in a textile mill. Such appliances are equipped with nozzle-type suction and blowing members which are interconnected via a blower or fan. The suction and blowing members sweep over the textile machine or the floor in the vicinity of the textile machine. Between the suction members and the fans there are arranged filter means which are located in the suction current during the extraction of the lint and which can periodically be cut off from the suction current, in order to transfer the lint removed therefrom into a collection bin, and which can be impinged upon by the air-blast stream or blower current. The filter means can be acted upon by the blower current in such a way that said current is either blown through the filter means in the opposite direction to the suction direction or is fed to that side of the filter means on which the lint has been deposited. In both cases the lint is blown away from the filter means and forwarded into the collection bin.

An apparatus of this type is described, for example, in German patent specification No. 1,454,589. A stationary apparatus for the removal of lint by suction is also described in German patent specification No. 846,368, in which apparatus the lint deposited on the filter means is periodically blown from the filter means into the collection bin, when the suction current is shut off, by means of a blower current.

The known appliances have the disadvantage that when the suction current is shut off the air-blast required for transferring the lint deposited on the filter means into the collecting bin has to be aspirated from the machine room. This air still contains lint or fly. The lint can accumulate in the fan or fan motor so that frequent cleaning is necessary. Moreover, in such appliances it is desirable for the blower current, which sweeps over the textile machines or the floor zone of these machines, to be less powerful than the suction current, since an excessively powerful air blast current in the lower machine zone would lead to lint being raised in considerable quantities, which could then be sucked in by the suction members only with difficulty. In the case of an excessively powerful blower current in the region between the roving bobbins and the winding bobbins of spinning machines, the danger of thread breakage also arises. It is desirable, therefore, to divert a portion of the blower current outwards into a machine area where it cannot raise any lint, e.g., upwards.

If then the suction current through the filter means is shut off for the transfer of the lint deposited on the filter means, then it is advantageous to allow the fan to continue to operate at full power, which has the result that it is not possible to use all the lint contaminated air sucked in from outside to blow off the lint deposited on the filter means. A portion of this air contaminated with lint has to be removed by the blowing members or tubes sweeping over the machine area and also by the generally upward directed blowing ducts, so that lint again reaches the machine area or the space above the machine area.

It is therefore, an object of the invention to have a lint-free blowing current available, even when the filter means are separated from the suction current, for the purpose of blowing off the lint deposited thereon.

SUMMARY OF THE INVENTION

Broadly, this invention contemplates an improvement in a pneumatic apparatus for removing lint, dust, dirt and debris surrounding textile machinery, i.e. deposited on textile machinery and/or on the floor and other surfaces in a textile mill, comprising a blower or fan having on one side thereof a first suction conduit and a second suction conduit, said suction conduits being generally opposed to one another such that air being sucked through one suction conduit runs in a generally opposite direction to air being sucked in the other suction conduit, said fan having a blower conduit on the other side thereof, filter means in each of said suction conduits for removing air entrained particles, the improvement residing in a normally open suction gate downstream of said filter means in each of said suction conduits which upon actuation closes to prevent air from passing therethrough, a normally closed first branch by-pass conduit in each of said suction conduits downstream of said filter means, said branch conduit having a conduit gate therein, said branch conduit by-passing said suction gate and being directed toward said filter means and means for opening and closing said suction gate and opening and closing said branch conduit gate.

In accordance with the present invention there is provided a mobile pneumatic apparatus for sucking and blowing lint and other air entrainable particles from textile machinery and the locus thereof, which apparatus has suction and blowing members which are interconnected via a fan and which sweep over the textile machinery or the vicinity thereof, such as the floor and other surfaces in a textile mill. The apparatus has arranged between the suction members and the fan filter means in each of the suction members which can be periodically cut off from the suction current to allow the lint or other dirt collected on the filter to be removed into a collecting bin or container. It is to be understood that the removal operation at one side or end of the mobile pneumatic apparatus is independent of the removal operation at the other. In fact, during the removal of lint from the filter of one suction conduit, the central fan or blower continues, and air being sucked through the opposed suction conduit is employed to "backwash" the filter of the other suction conduit. To provide this function, there are provided at least one by-pass conduit in each of the respective suction conduits which by-pass a normally open suction gate and which are directed toward the downstream side of the filter. In operation the suction gate is closed, and the branch by-pass conduit is open to allow the air from the opposed side of the pneumatic apparatus to pass through the branch conduit and impinge against the downstream side of the filter. At the time that the suction gate is closed and the branch conduit is opened, a chute gate in a chute in facing relationship with the upstream side of the filter is opened to allow the filtered particles to pass therethrough into a collection bin.

The apparatus according to the invention is characterized in that there are provided two separate filter means lying in the suction-air stream during the extraction of the lint, one of which means alternately can be cut off from the suction-air stream, for the transfer of the lint deposited thereon into the collection bin, by a shut-off device and can be acted upon via an air-blast duct, which contains a change-over valve coupled with the shut-off device, by at least part of the air-blast stream filtered by the other filter means still lying in the suction-air stream.

Therefore, while the lint is being blown off of the filter means no longer located in the suction-air stream, the other filter means is still located in the suction-current so that there flows through the still operating blowing members or air-blast ducts a blowing current, which is supplied by a filtered suction current. Consequently, no lint can be carried by this blowing current into the machine room.

Another advantage of the apparatus according to the invention lies in the fact that the suction currents passing through the two separate filter means enter the fan from two sides, whereby the distance travelled by the suction currents is made shorter. In this way the efficiency of the fan is increased.

Preferably, the change-over valve for the blowing duct is so coupled with the shut-off device of the filter means that when the shut-off device is open the blowing current can be directed towards the exterior through a branch of the blowing duct. This embodiment thus applies to the case in which, during the depositing of the lint on the filter means, a portion of the blowing current is not conveyed to the blower members or tubes in the machine area but towards the exterior, preferably into the space above the machine area.

In a preferred embodiment, moreover, a branch of the blowing duct discharges into the space between the filter means and shut-off device, i.e., that portion of the blowing current used to transfer the lint deposited on the filter means into the collection bin is directed through the filter means. This portion of the blowing current thus flows in opposite direction to the suction current through the filter means, whereby the lint which has penetrated into the mesh of the filter is blown out.

In another embodiment a branch of the blowing duct discharges, as in the first embodiment, into the space between the filter means and shut-off device so that a portion of the blowing current removes the lint situated in the mesh. Another branch of the blowing duct discharges into a space outside the filter means, i.e. upstream, so that the lint deposited thereon is blown away tangentially. In a specially preferred embodiment the trackway traverses this space which has a sloping floor from which the blasted off lint can be discharged into a collection bin common to both filter means and arranged laterally to the trackway.

BRIEF DESCRIPTION OF DRAWINGS

The invention is illustrated in the following on the basis of the drawing, in which.

DESCRIPTION OF PREFERRED EMBODIMENTS

Figure 1:
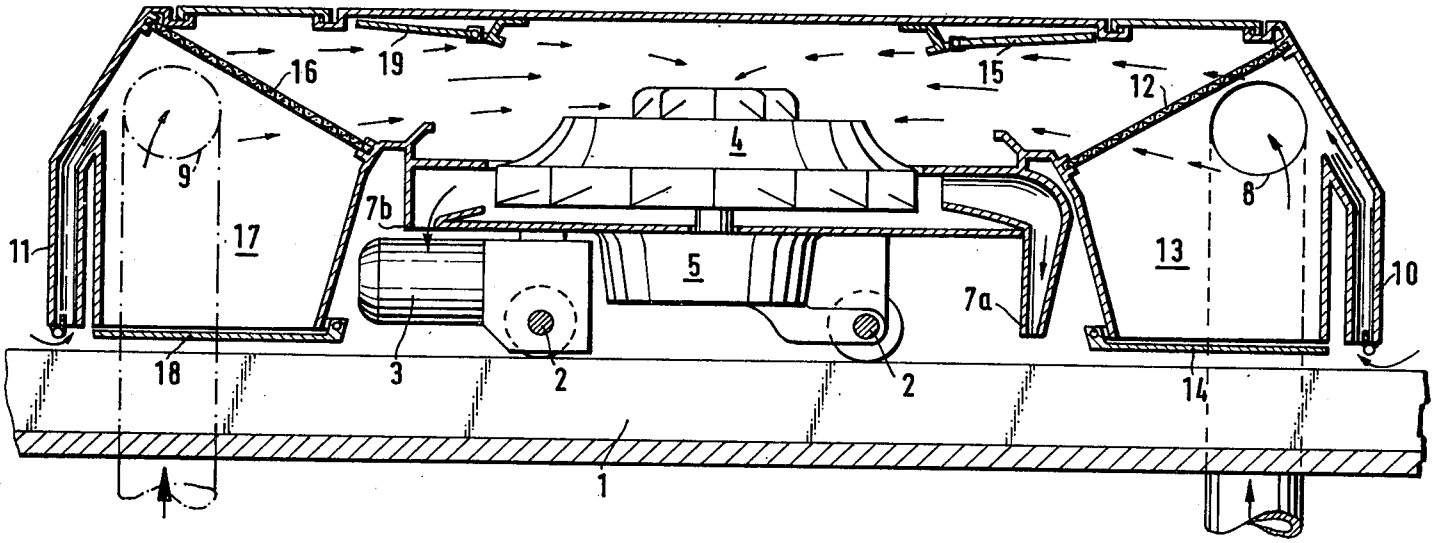
FIG. 1 shows a longitudinal section through a first embodiment of the apparatus according to the invention, both filter means being arranged in the suction current of the fan.
Figure 2:
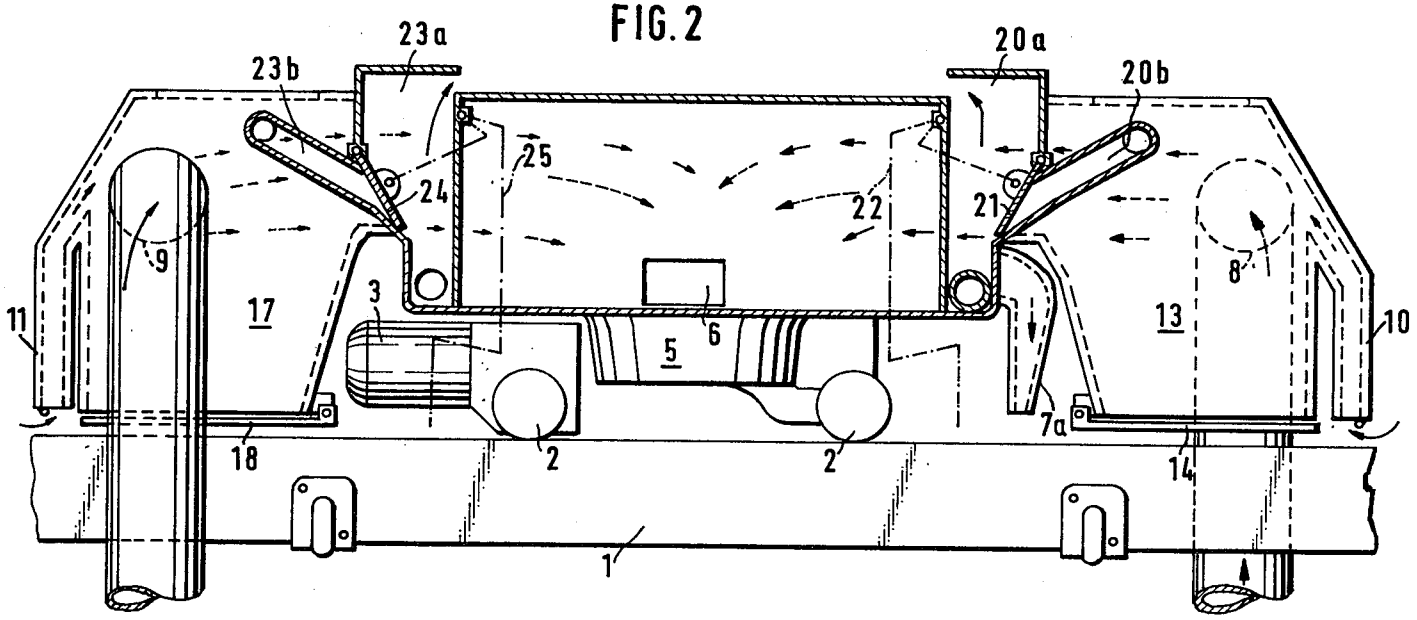
FIG. 2 shows a longitudinal section parallel to that of FIG. 1 and taken through the members arranged laterally of the fan housing.
Figure 3:
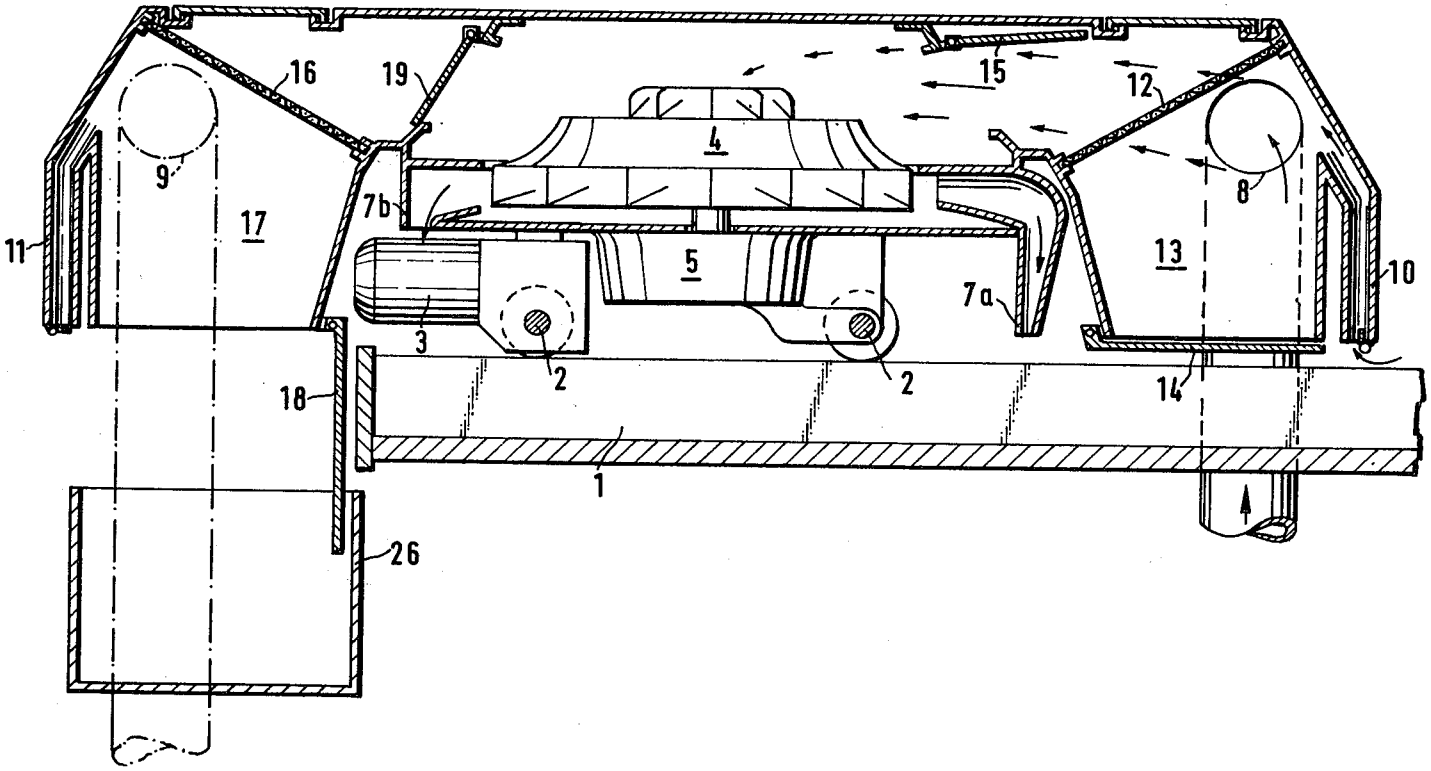
FIG. 3 shows a longitudinal section like FIG. 1, in which one filter means is situated in the suction current of the fan and the other one is impinged by the blowing current for the transfer of lint into a collection bin.
Figure 4:
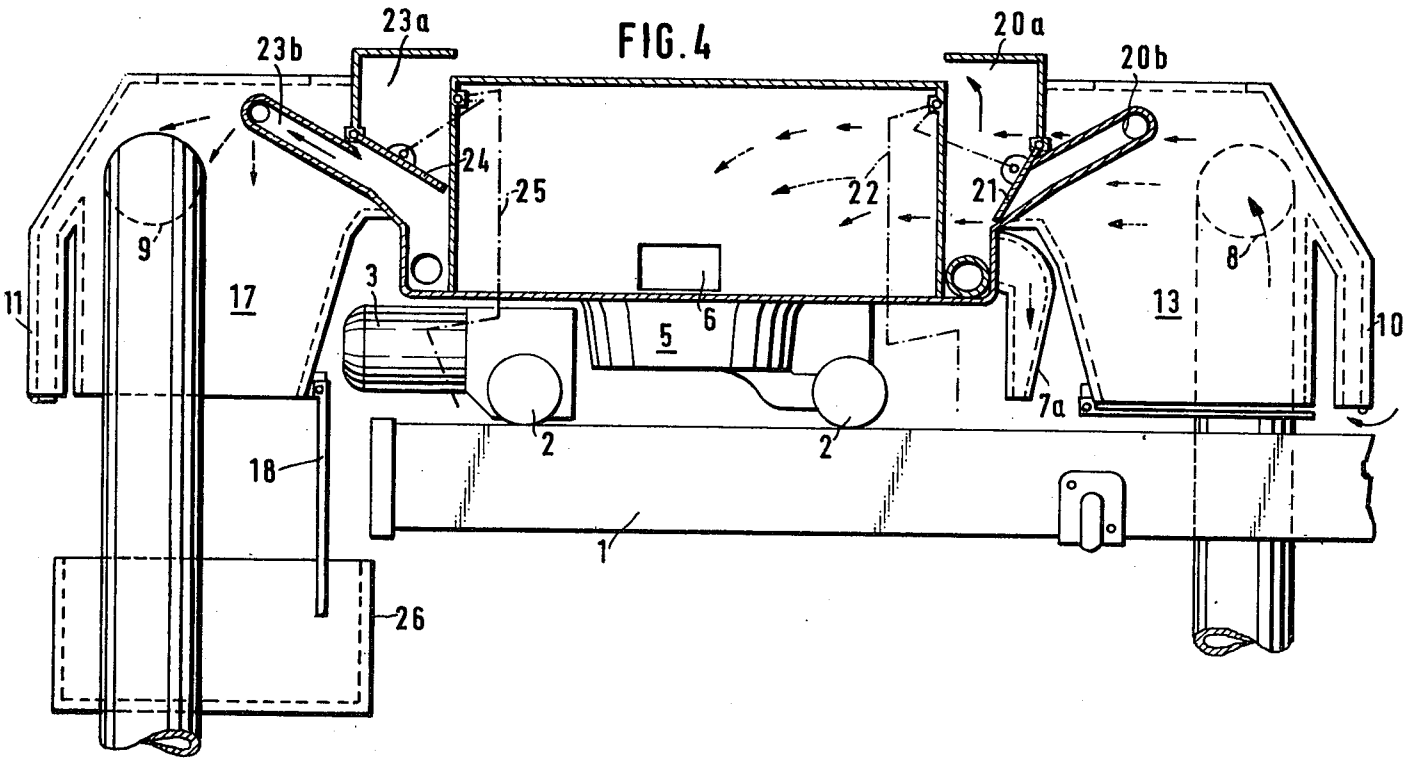
FIG. 4 shows a longitudinal section like FIG. 3, in an operating position like FIG. 2.

The apparatus illustrated in FIGS. 1 to 4 in accordance with the first embodiment runs along a rail or trackway 1 on an under-carriage 2 which is driven by a drive motor 3. Above the under-carriage there is arranged in a housing the fan or blower 4, e.g., a radial blower, which is driven by the blower motor 5. The blower members 6, **7*a* and 7*b* lead away from the blower. The blower member 6 is indicated in FIGS. 2 and 4 by an aperture on the blast side of the fan 4. In general the blower members are blast nozzles which at a certain lateral distance from the trackway 1, can be directed towards the lower zone of the textile machine or towards the floor area of the machine, as will be explained in more detail in connection with the second embodiment in FIGS. 9 and 10. The blower members 7*a* and 7*b* are represented in FIG. 1 by short pipes which sweep over the drive motor 3 and the trackway 1. At points 8 and 9 the main suction members are attached to the fan housing, which members may take the form of suction nozzles similar to the blower member 6 (corresponding to the suction nozzles in the second embodiment according to FIGS. 9 and 10), and which extend down into the lower zone or down to the floor area of the textile machine and suck up the lint deposited there. Furthermore, there are provided two auxiliary suction members 10 and 11** which take the form of thin tubes passing over the trackway, and suck up the lint deposited there. The auxiliary suction members can be closed by flaps.

The filter means 12 and 16, which may be of conventional type, are provided between the suction members and the fan. The filter means are adjoined externally by the filter boxes 13 and 17, respectively, which are covered by the filter-box covers 14 and 18, respectively. Between the filter means and the fans there are further provided the shut-off members 15 and 19 which take the form of flaps. The function of these shut-off members is explained in further detail in the following.

Laterally to the fan box (see FIG. 2) there are arranged the air-blast ducts 20 and 23, which are supplied by the blowing current from the fan 4. The air blast ducts are subdivided into the outwardly directed branches 20*a* and 23*a*, respectively, and into the branches 20*b* and 23*b* leading to the filter means 12 and 16, respectively. Between these two branches there are arranged the change-over valves 21 and 24 which are actuated by the linkages 22 and 25, respectively. The change-over valve 21 is coupled via the linkage 22 with the shut-off device 15 and the change-over valve 24 is coupled via the linkage 25 with the shut off device 19 in the manner to be explained in the following.

In the operating position illustrated in FIGS. 1 and 2 the air containing lint is drawn in through the suction members 8 to 11 and flows through the filter means 12 and 16, the shut-off devices 15 and 19 being open.

It is noticeable that the two suction currents indicated by arrows travel a relatively short distance, i.e., the suction currents only reach as far as the center axis of the fan in each case so that the efficiency of the fan is improved.

The lint is deposited on the filter devices. The filtered suction air enters the fan 4 and is delivered as an air blast partly by the blower members 6, 7*a* and 7*b* and serves to clean the machine and the trackway. Another portion of the filtered air blast is delivered upwards through the branches 20*a* and 23*a* of the air-blast duct, the branches 20*b* and 23*b* being closed by the change-over valves 21 and 24, respectively.

When the apparatus travels into the operating position illustrated in FIGS. 3 and 4, i.e., it reaches the end of trackway 1, then the linkage 25 is actuated by suitable means, e.g., a stop member (not shown), whereby the shut off device 19 is closed and simultaneously the change-over valve 24 is swung into the position shown in FIG. 4. At the same time the filter-box cover 18 is opened. This can be done by actuation of the linkage 25, or by a separate member (not shown) attached to the cover 18 and cooperating with a stop at the end of trackway 1. The suction current through the filter means 16 is interrupted and simultaneously a portion of the blower current through the branch 23*b* of the air-blast duct is blown in opposite direction to the suction current through the filter means 16. The lint deposited on the filter means 16 drops through the filter box 17 into the collection bin 26.

During this operation, however, the shut-off device 15 remains open, so that the suction current through the filter means 12 is maintained. That portion of the blowing current not used for blowing through the filter means 16 passes to the exterior partly via the blower members 6, 7*a* and 7*b* and partly via the branch 20*a* of the air-blast duct.

After the lint has been transferred into the collecting bin 26, the drive motor 3 receives a reversing impulse (either mechanically by means of a reversing gear or electrically by reversing the phases of the motor) and the apparatus moves to the right along the rail 1, in which case the filter-box cover 18 is closed and the linkage 25 is actuated in order to open the shut-off device 19 and to swing the change-over valve 24 back into the position shown in FIG. 2. Both filter means 12 and 16 are now situated in the suction current again.

When the apparatus reaches the other end of the trackway the filter box cover 14 opens and the shut-off device 15 closes, in which case the change-over valve 21 opens the branch 20*b* of the air-blast duct. This can be done by means of linkage 22 or by a separate member (not shown) attached to the cover 14 and cooperating with a stop at the other end of trackway 1. The discharging of the lint into a collection bin arranged at the other end of the trackway takes place in precisely the same way as at that end of the trackway illustrated in FIGS. 3 and 4.

The apparatus according to the embodiment illustrated in FIGS. 5 to 10 corresponds to the apparatus according to the first embodiment in respect of the main features. The discharging of the lint merely takes place instead at any desired point along the length of the trackway 1 and not at each end thereof.

Figure 5:
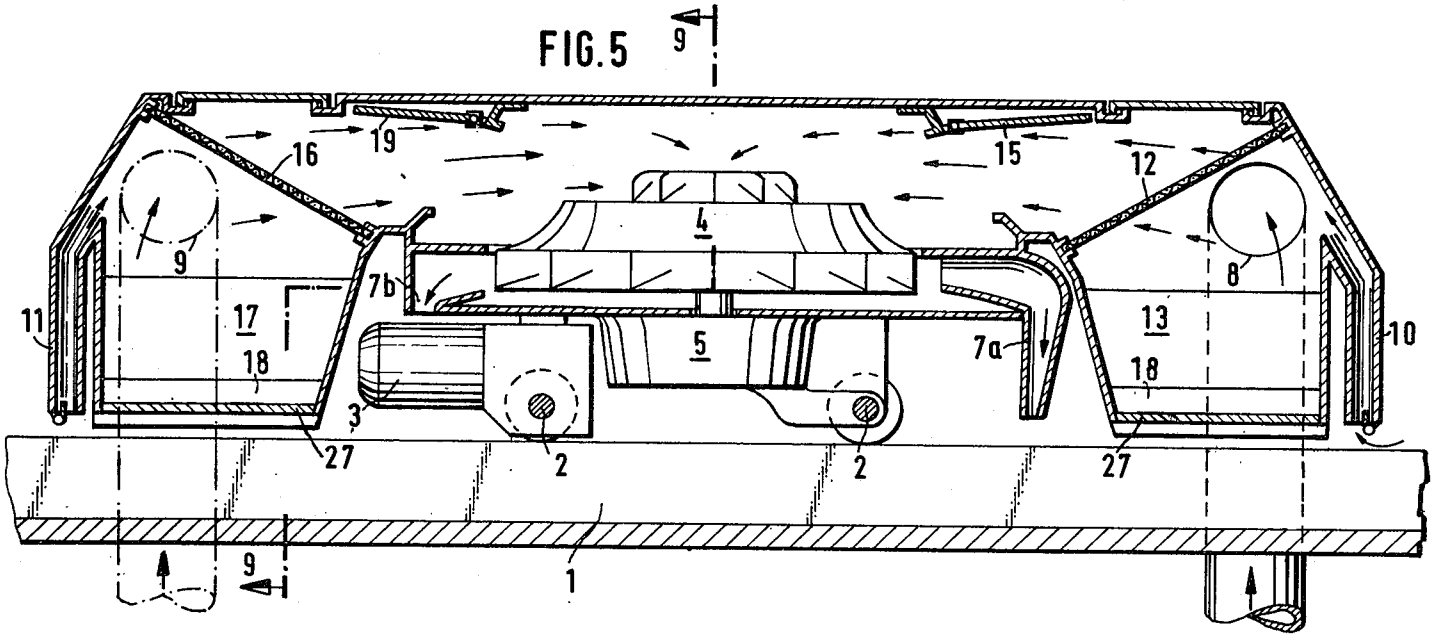
FIG. 5 shows a longitudinal section taken along the line 5—5 of FIG. 9 through a second embodiment of the apparatus according to the invention, both filter means being arranged in the suction current of the fan.
Figure 6:
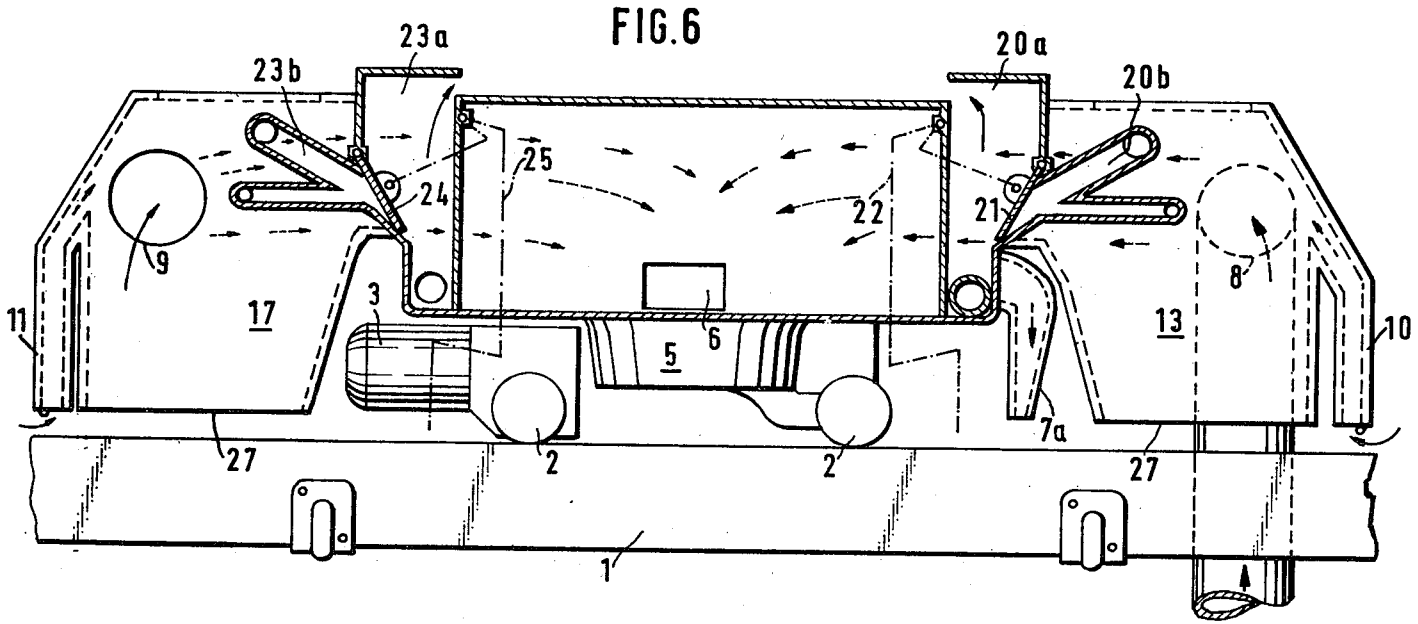
FIG. 6 shows a longitudinal section taken along the line 6—6 of FIG. 9.
Figure 9:
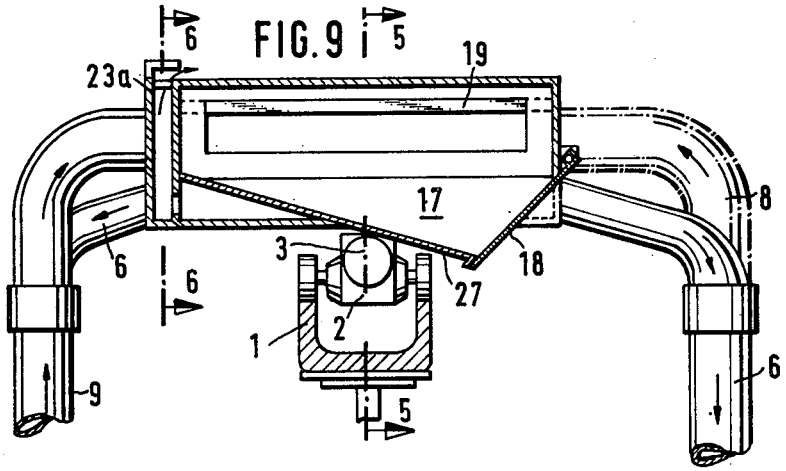
FIG. 9 shows a transverse section taken approximately along the line 9—9 of FIG. 5.

In the operating position illustrated in FIGS. 5, 6 and 9 the filter means 12 and 16 are disposed in the suction current of the fan 4 exactly as in the first embodiment.

Figure 7:
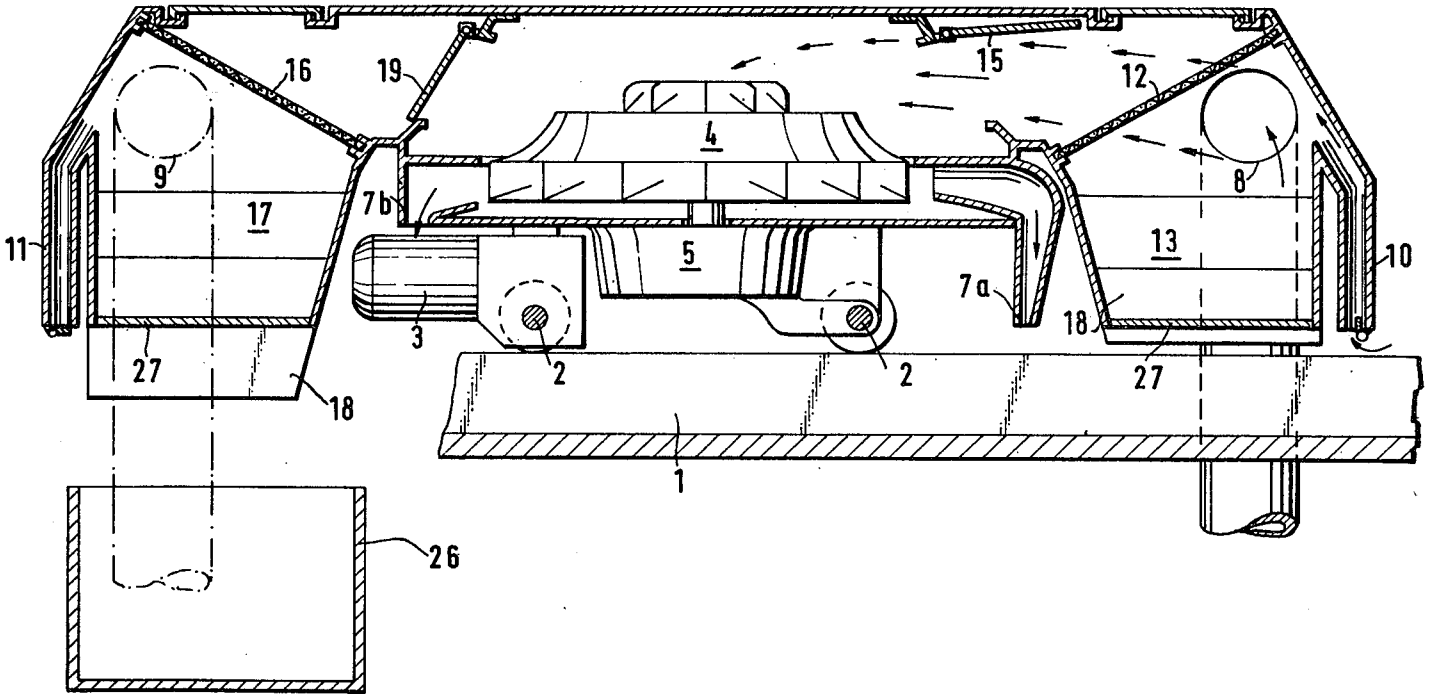
FIG. 7 shows a longitudinal section taken along the line 7—7 of FIG. 10; in which one filter means is situated in the suction current of the fan and the other one is acted upon by the blowing current for the transfer of lint into a collection bin.
Figure 8:
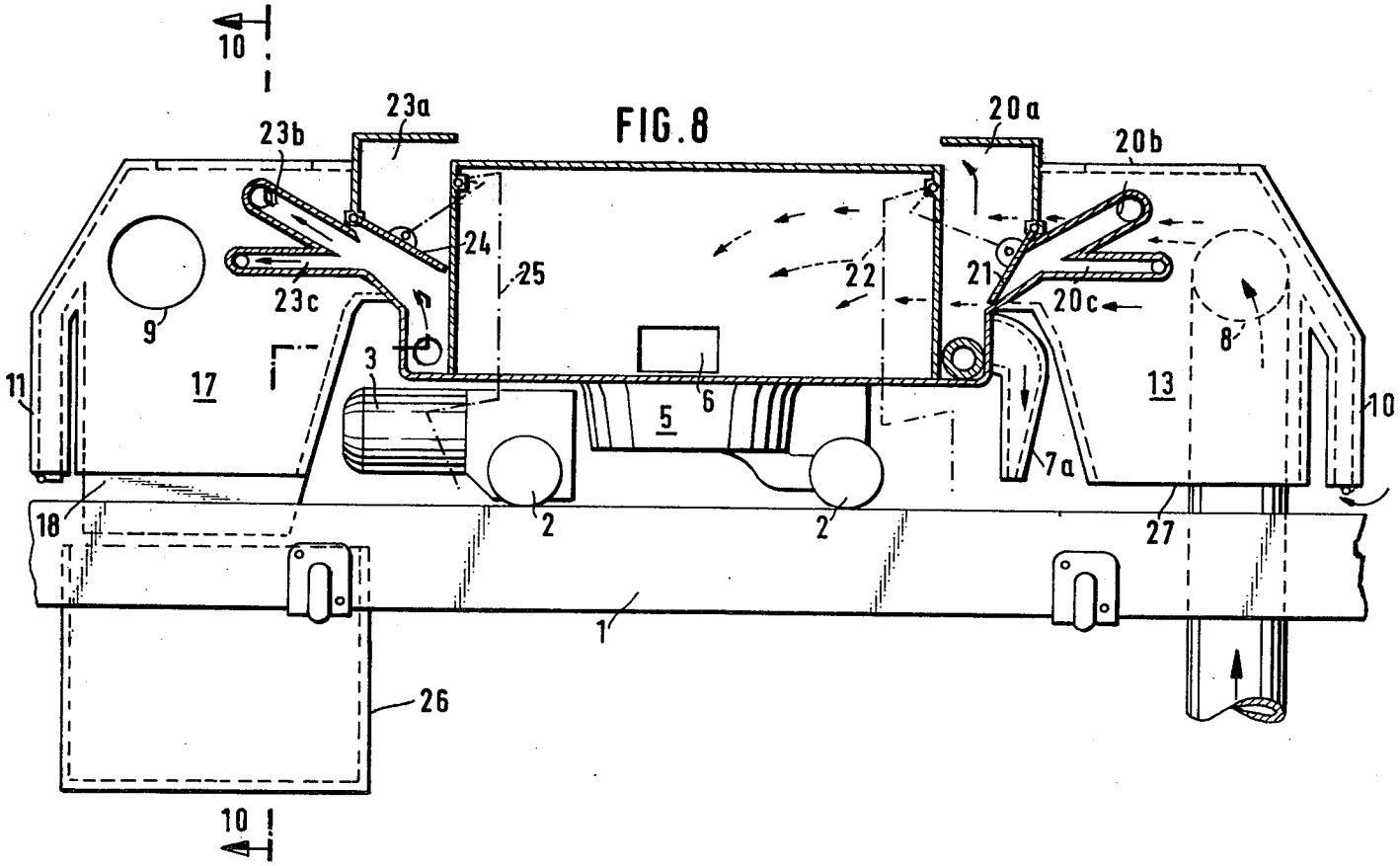
FIG. 8 shows a longitudinal section taken along the line 8—8 of FIG. 10.
Figure 10:
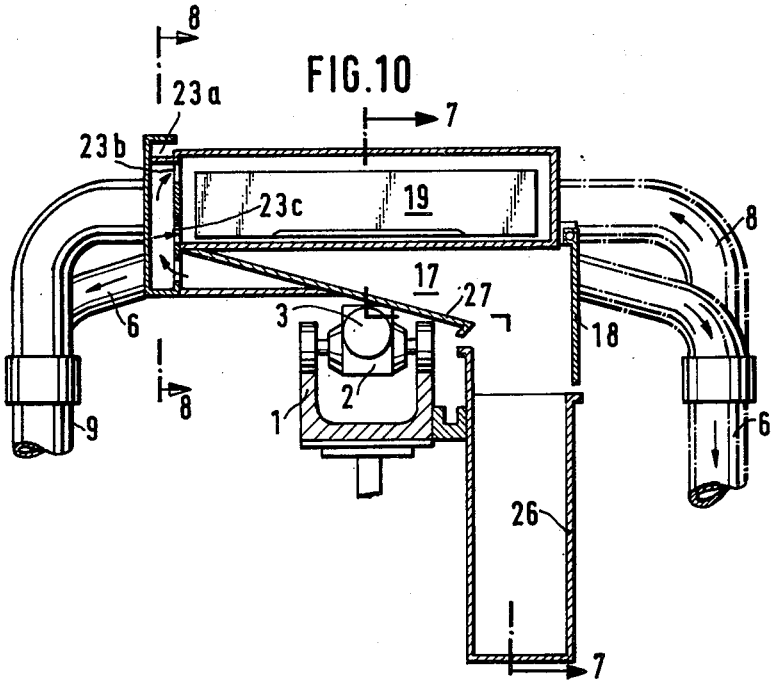
FIG. 10 shows a transverse section taken approximately along the line 10—10 of FIG. 8.

In the operating position illustrated in FIGS. 7, 8 and 10, in which the lint deposited on the filter means 16 has been removed, the linkage 25 has closed the shut-off device 19 and so reversed the change-over valve 24 that the blowing current can no longer flow outwards through the branch 23*a* of the air-blast duct, but flows into the branch 23*b* (as in the first embodiment) and also additionally into the branch 23*c* of the air-blast duct. This branch discharges into the space 17 outside the filter means 16 and the outflowing blowing current sweeps tangentially over the lint deposited on the filter means 16 so that said lint is detached from the filter means 16. The space 17, into which the blown-off lint falls, traverses the trackway 1 (see FIGS. 9 and 10) and has an inclined floor 27 over which the detached lint is transferred, by means of the blowing current issuing from the branch 23*c* (FIG. 10) into a collection bin 26 arranged beside the trackway. As in the first embodiment, the filter means 12 is situated also in this operating position in the blowing current, in which case that portion of the blowing current not used for blasting the filter means 16 is directed towards the exterior partly through the blower members 6, 7*a* and 7*b* and partly through the branch 20*a* of the air-blast duct.

After completion of the transfer of the lint deposited on the filter device 16 into the collection bin 26, the apparatus travels further to the left from the position illustrated in FIGS. 7 and 8, in which case the linkage 25 again opens the shut-off device 19 and brings the change-over valve 24 into the position illustrated in FIG. 6.

In the event of further travel of the apparatus, the linkage 22 is actuated when the filter box 13 is situated above the storage container 26. In this case the shut-off member 15 is closed and simultaneously the change-over valve is so swung around that the air-blast stream flows into the branches 20*b* and 20*c* of the air-blast duct, and the lint deposited on the filter means 12 is transferred into the space 13 which, like the space 17, is disposed transversely across the trackway 1 and which likewise has a sloping floor 27, and is transferred from this space into the collection bin 26. Accordingly, only a single collection bin needs to be used for the transfer of the lint deposited on the two filter means 12 and 16.

Once the apparatus has reached the end of the trackway, it receives a reversing impulse (either mechanically by means of a reversing gear, or electrically by reversing the phases of the motor), in which case first the filter means 12 is freed of lint and then the filter device 16, when these two devices successively reach the position of the collection bin 26.

The trackway may, however, also take the form of an endless trackway, in which case the apparatus always runs in the same direction.

What is claimed is:

1. In a pneumatic apparatus for removing particulate matter surrounding textile machines comprising, within a housing, a fan having on the suction side (upstream) thereof a first suction member and a second suction member, said housing defining respective passages for each of said suction members to the inlet of said fan, said passages being generally opposed to one another such that air being sucked through one of said passages runs in a generally opposite direction to air being sucked through the other of said passages, said fan having blower members on the pressure side (downstream) of said fan, first and second filter means within each of said respective passages for removing entrained particles from air being sucked through said passages, the improvement which comprises, within the respective passages, first and second shut-off members between said first and second filter means, respectively, and said fan; first and second blow ducts connecting the pressure side of side fan with the upstream said of said first and second shut-off members, respectively, said shut-off members being open and said blow ducts being closed during most of the operating time; and means adapted to alternately close said first shut-off member while simultaneously opening said first blow duct for a brief interval during the operating time, and to close said second shut-off member while simultaneously opening said second blow duct for another brief interval during the operating time, so as to alternately and separately detach said particulate matter from each of said first and second filter means, while simultaneously continuing to pass an air stream through the other of said first and second filter means to thereby continue to pass an air stream free of said particulate matter through said fan and respective blow dust.

2. An apparatus according to claim 1, wherein each of said blow ducts comprises a branch conduit that delivers an air stream free of said particulate matter into the atmosphere when the respective shut-off member is opened.

3. Apparatus according to claim 1, wherein said alternate closing means comprises first and second linkages that are operatively connected to the first and second shut-off members and to first and second change over valves to alternately close and open said first and second blow ducts as said first and second shut-off members are opened and closed, respectively.

4. An apparatus according to claim 3, wherein upstream of each of said filter means there is a chute in registry with said filter means, said chute having an openable chute gate therein.

5. An apparatus according to claim 4, wherein each of said openable chute gates is operatively connected to a respective one of said linkages, so as to be opened by the respective linkage when the respective shut-off member is closed and the respective blow duct is opened by the respective linkage.

6. An apparatus according to claim 1 wherein said pneumatic apparatus is mobile and comprises means for self-propelling the same.

7. An apparatus according to claim 6 wherein said pneumatic apparatus is disposed on a trackway.

8. An apparatus according to claim 1 wherein each of said blow ducts is directed at the respective filter means at a point downstream thereof, for blowing air through the respective filter means when the respective shut-off member is closed, so as to detach said particulate matter from said filter means.

9. An apparatus according to claim 8, wherein upstream of each of said filter means there is a chute in registry with said filter means, each of said chutes having a sloping openable chute gate therein.

10. An apparatus according to claim 9, wherein each of said openable chute gates is operatively connected to a respective one of said linkages so as to be opened by the respective linkage when the respective shut-off member is closed and the respective blow duct is opened by the respective linkage.

11. An apparatus according to claim 1 wherein each of said blow ducts comprises a second branch conduit (20c, 23c) which is directed at the respective filter means at a point upstream thereof for blowing air tangentially over said particulate matter deposited on the respective filter means so as to detach said particulate matter from said filter means.

* * * * *

UNITED STATES PATENT AND TRADEMARK OFFICE

CERTIFICATE OF CORRECTION

PATENT NO. : 4,121,317

DATED : October 24, 1978

INVENTOR(S) : Hubert Sohler

It is certified that error appears in the above-identified patent and that said Letters Patent are hereby corrected as shown below:

Column 5, line 65, after "actuated" insert -- again --.

Column 7, line 41, Claim 1, line 41, "dust" should read -- duct --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*